US006532602B2

(12) United States Patent
Watters et al.

(10) Patent No.: US 6,532,602 B2
(45) Date of Patent: Mar. 18, 2003

(54) INSERT-MOLDED HELMET

(75) Inventors: Robert D. Watters, Ottawa (CA); John C. Tutton, North Gower (CA); Aldo F. Balatti, Greely (CA); Mark A. Fletcher, Ottawa (CA); Nicholas Shewchenko, Chelsea (CA); Timothy Douglas Bayne, Ottawa (CA); Christopher Robert Patrick Withnall, Nepean (CA)

(73) Assignee: Sportscope, Inc., Chicago, IL (US)

( * ) Notice: Subject to any disclaimer, the term of this patent is extended or adjusted under 35 U.S.C. 154(b) by 0 days.

(21) Appl. No.: 09/941,088

(22) Filed: Aug. 27, 2001

(65) Prior Publication Data

US 2002/0023290 A1 Feb. 28, 2002

Related U.S. Application Data

(63) Continuation of application No. 09/160,655, filed on Sep. 25, 1998, now Pat. No. 6,292,952.

(51) Int. Cl.[7] ..... A42B 3/00

(52) U.S. Cl. ..... 2/411; 2/412; 2/421; 2/425

(58) Field of Search ..... 2/425, 410, 414, 2/417, 418, 419, 420, 421, 422, 411, 412

(56) References Cited

U.S. PATENT DOCUMENTS

| | | | | |
|---|---|---|---|---|
| 1,373,446 A | | 5/1921 | Pierce | |
| 1,559,252 A | | 10/1925 | Hartman | |
| 2,181,180 A | | 11/1939 | Feige | |
| 2,381,524 A | | 8/1945 | Taylor | |
| 2,710,972 A | | 6/1955 | Radnofsky | |
| 2,861,274 A | | 11/1958 | Stuart et al. | |
| 2,871,484 A | * | 2/1959 | Finken et al. | 2/418 |
| 3,087,166 A | | 4/1963 | Howard | |
| 3,155,981 A | | 11/1964 | McKissick et al. | 2/422 |
| 3,197,784 A | | 8/1965 | Carlisle | 2/420 |
| 3,204,251 A | | 9/1965 | Child | |
| 3,665,514 A | * | 5/1972 | Durand | 2/420 |

(List continued on next page.)

FOREIGN PATENT DOCUMENTS

| | | |
|---|---|---|
| CA | 1147501 | 3/1983 |
| CN | 1122275 A | 5/1996 |
| CN | 1131524 A | 9/1996 |

(List continued on next page.)

*Primary Examiner*—Rodney M. Lindsey
(74) *Attorney, Agent, or Firm*—Michael D. Rechtin; Foley & Lardner

(57) ABSTRACT

A comfortable, self-adjusting, protective helmet made from a process of insert molding. The helmet comprises an armature or insert made of a porous material that is embedded in the layers of the helmet to connect the structural parts of the helmet to one another. The armature as used in the helmet also serves several other functions which include hinging and sizing. A retention system is strategically located on the helmet to provide increased stabilization of the helmet on the wearer's head. One embodiment of this invention is an insert-molded helmet that can be converted into a pouch. A further embodiment of this invention includes a protrusion at the back of a helmet suitable for a compartment.

20 Claims, 6 Drawing Sheets

U.S. PATENT DOCUMENTS

| | | | | | |
|---|---|---|---|---|---|
| 3,765,031 | A | | 10/1973 | Beresic | 2/422 |
| 3,934,271 | A | | 1/1976 | Rhee | |
| 3,990,131 | A | | 11/1976 | Okamura | 24/221 R |
| 3,991,422 | A | | 11/1976 | Saotome | |
| 3,992,722 | A | | 11/1976 | Rhee | |
| 4,023,209 | A | | 5/1977 | Frieder, Jr. et al. | |
| 4,044,400 | A | | 8/1977 | Lewicki et al. | |
| 4,058,854 | A | | 11/1977 | Rhee | |
| 4,100,625 | A | | 7/1978 | Tung | |
| 4,185,331 | A | | 1/1980 | Nomiyama | |
| 4,274,271 | A | | 6/1981 | Todd et al. | |
| 4,434,514 | A | | 3/1984 | Sundahl et al. | |
| 4,443,891 | A | | 4/1984 | Blomgren et al. | |
| 4,461,044 | A | | 7/1984 | Reiterman et al. | |
| 4,477,929 | A | | 10/1984 | Mattsson | |
| 4,586,200 | A | | 5/1986 | Poon | |
| 4,607,397 | A | | 8/1986 | Laxo | |
| 4,665,569 | A | | 5/1987 | Santini | |
| 4,724,549 | A | | 2/1988 | Herder et al. | |
| 4,744,107 | A | | 5/1988 | Fohl | |
| 4,766,616 | A | | 8/1988 | Donahue | |
| 4,776,324 | A | | 10/1988 | Clarren | |
| 4,808,469 | A | | 2/1989 | Hiles | |
| 4,827,537 | A | | 5/1989 | Villa | |
| 4,845,786 | A | | 7/1989 | Chiarella | |
| 4,856,119 | A | * | 8/1989 | Haberle | 2/417 |
| 4,897,888 | A | | 2/1990 | Broersma et al. | |
| 4,901,373 | A | | 2/1990 | Broersma | |
| 4,903,348 | A | | 2/1990 | Broersma | |
| 4,903,350 | A | | 2/1990 | Gentes et al. | |
| 4,912,777 | A | | 4/1990 | Gasbarro | |
| 4,972,527 | A | | 11/1990 | Wallace | |
| 4,993,082 | A | | 2/1991 | Gentes et al. | |
| 4,995,117 | A | | 2/1991 | Mirage | |
| D316,165 | S | | 4/1991 | Gentes et al. | |
| 5,005,220 | A | | 4/1991 | Gaiatto et al. | 2/421 |
| 5,007,141 | A | | 4/1991 | Gentes | |
| 5,023,958 | A | | 6/1991 | Rotzin | |
| 5,083,321 | A | | 1/1992 | Davidsson | |
| 5,088,130 | A | | 2/1992 | Chiarella | 2/411 |
| 5,088,633 | A | | 2/1992 | Cunard et al. | |
| 5,097,538 | A | | 3/1992 | Fealing | |
| 5,099,523 | A | | 3/1992 | Broersma | |
| 5,117,662 | A | | 6/1992 | Holmes | |
| 5,119,516 | A | | 6/1992 | Broersma | |
| 5,123,121 | A | | 6/1992 | Broersma | |
| 5,139,017 | A | | 8/1992 | McCloud | |
| 5,148,550 | A | | 9/1992 | Adgkinson et al. | 2/424 |
| 5,148,950 | A | | 9/1992 | Hosaka | |
| 5,151,944 | A | | 9/1992 | Yamamura | |
| D335,195 | S | | 4/1993 | Choe et al. | |
| 5,231,704 | A | | 8/1993 | Hildenbrand | |
| D339,427 | S | | 9/1993 | Gentes | |
| 5,267,767 | A | | 12/1993 | Farrow | |
| 5,269,025 | A | | 12/1993 | Broersma | |
| 5,271,102 | A | | 12/1993 | Feuling | |
| 5,271,103 | A | * | 12/1993 | Darnell | 2/411 |
| 5,272,773 | A | | 12/1993 | Kamata | |
| 5,294,914 | A | | 3/1994 | Dallas | |
| D347,300 | S | | 5/1994 | Gentes | |
| D347,711 | S | | 6/1994 | Egger | |
| D348,392 | S | | 7/1994 | Tanner | |
| D348,545 | S | | 7/1994 | Egger | |
| D348,750 | S | | 7/1994 | Egger | |
| 5,327,588 | A | | 7/1994 | Gerneau | |
| 5,329,641 | A | | 7/1994 | Kalhous | |
| 5,333,329 | A | | 8/1994 | Hong | |
| 5,351,341 | A | | 10/1994 | Broersma | |
| 5,353,008 | A | | 10/1994 | Eikenberry et al. | |
| D352,803 | S | | 11/1994 | Sasaki et al. | |
| 5,365,615 | A | | 11/1994 | Piszkin | |
| 5,376,318 | A | | 12/1994 | Ho | |
| 5,381,560 | A | | 1/1995 | Halstead | |
| 5,424,021 | A | | 6/1995 | Nakade et al. | |
| 5,426,792 | A | | 6/1995 | Murasko | |
| 5,438,702 | A | | 8/1995 | Jackson | |
| D362,084 | S | | 9/1995 | Egger | |
| 5,450,631 | A | | 9/1995 | Egger | |
| 5,465,421 | A | | 11/1995 | McCormick et al. | |
| 5,467,485 | A | | 11/1995 | Casartelli | 2/421 |
| 5,469,583 | A | | 11/1995 | Akeley et al. | |
| 5,477,563 | A | | 12/1995 | Gentes et al. | |
| 5,479,325 | A | | 12/1995 | Chien | |
| 5,481,759 | A | | 1/1996 | Rinaldi | |
| 5,481,762 | A | | 1/1996 | Gentes et al. | |
| 5,493,736 | A | | 2/1996 | Allison | |
| 5,508,900 | A | | 4/1996 | Norman | |
| 5,517,698 | A | | 5/1996 | Nault et al. | |
| 5,519,895 | A | | 5/1996 | Barnes, Jr. | 2/422 |
| D371,224 | S | | 6/1996 | Carlson et al. | |
| 5,544,027 | A | | 8/1996 | Orsano | |
| 5,551,094 | A | | 9/1996 | Navone | |
| 5,555,570 | A | | 9/1996 | Bay, Jr. | |
| 5,555,584 | A | | 9/1996 | Moore, III et al. | |
| 5,557,807 | A | | 9/1996 | Hujar et al. | |
| 5,559,680 | A | | 9/1996 | Tabanera | |
| 5,564,129 | A | | 10/1996 | Ball et al. | |
| 5,581,819 | A | | 12/1996 | Garneau | 2/421 |
| 5,592,936 | A | | 1/1997 | Thomas, Jr. et al. | |
| 5,604,958 | A | | 2/1997 | Ansher | 24/3.1 |
| 5,608,918 | A | | 3/1997 | Salvaggio | |
| 5,615,410 | A | | 3/1997 | DeMars | |
| 5,615,419 | A | | 4/1997 | Williams | |
| 5,619,756 | A | | 4/1997 | Garneau | |
| 5,621,923 | A | | 4/1997 | Tapocik | |
| D380,870 | S | | 7/1997 | Szabados | |
| 5,651,145 | A | | 7/1997 | Egger | |
| 5,651,848 | A | | 7/1997 | Cohee et al. | |
| 5,659,900 | A | | 8/1997 | Arney et al. | |
| D383,875 | S | | 9/1997 | Morgan | |
| 5,661,854 | A | | 9/1997 | March, II | |
| 5,664,444 | A | | 9/1997 | Schaan | |
| 5,666,700 | A | | 9/1997 | Anscher et al. | |
| 5,669,079 | A | | 9/1997 | Morgan | |
| 5,675,843 | A | | 10/1997 | Grim et al. | |
| 5,685,020 | A | | 11/1997 | Powell et al. | |
| 5,687,426 | A | | 11/1997 | Sperber | |
| D387,501 | S | | 12/1997 | Cheng | |
| 5,699,561 | A | | 12/1997 | Broersma | |
| 5,701,609 | A | | 12/1997 | Bridges | |
| 5,718,004 | A | | 2/1998 | Broersma et al. | |
| 5,724,681 | A | | 3/1998 | Sykes | 2/425 |
| 5,729,877 | A | | 3/1998 | Kong et al. | |
| 5,732,414 | A | | 3/1998 | Monica | |
| 5,737,777 | A | | 4/1998 | Hilleary | |
| 5,745,923 | A | | 5/1998 | Katz | |
| 5,745,924 | A | | 5/1998 | Egger | |
| 5,746,442 | A | | 5/1998 | Hoyaukin | |
| 5,753,061 | A | | 5/1998 | Rudy | |
| 5,768,714 | A | | 6/1998 | Bowhey | |
| 5,774,901 | A | | 7/1998 | Minami | |
| 5,794,272 | A | | 8/1998 | Workman et al. | |
| 5,809,578 | A | | 9/1998 | Williams | |
| 5,813,055 | A | | 9/1998 | Egger | |
| 5,815,846 | A | | 10/1998 | Calonge | |
| 5,833,796 | A | | 11/1998 | Matich | |
| 5,839,121 | A | | 11/1998 | Morales | |
| 5,862,528 | A | | 1/1999 | Saijo et al. | |
| 5,867,840 | A | | 2/1999 | Hirosawa et al. | |
| 5,871,271 | A | | 2/1999 | Chien | |
| 5,874,151 | A | | 2/1999 | Cohee et al. | |

| | | | | | |
|---|---|---|---|---|---|
| 5,887,288 | A | | 3/1999 | Arney et al. | |
| D407,860 | S | | 4/1999 | Cox et al. | |
| 5,896,587 | A | | 4/1999 | Gentry | |
| 5,930,841 | A | * | 8/1999 | Lampe et al. | 2/411 |

FOREIGN PATENT DOCUMENTS

| | | | |
|---|---|---|---|
| DE | 3116037 | A1 | 4/1981 |
| DE | 2098852 | A | 3/1982 |
| DE | 3632525 | | 3/1988 |
| DE | 4009036 | A1 | 3/1990 |
| EP | 0074658 | A2 | 9/1982 |
| EP | 0150876 | A2 | 1/1985 |
| EP | 0259516 | A1 | 9/1986 |
| EP | 0280042 | A1 | 1/1987 |
| EP | 0815754 | A1 | 6/1996 |
| EP | 0743022 | A2 | 11/1996 |
| EP | 0792592 | A1 | 2/1997 |
| FR | 2490466 | | 9/1980 |
| FR | 2680305 | * | 2/1993 |
| GB | 2220556 | B | 7/1990 |
| JP | 61-215014 | | 3/1985 |
| SE | 8003048-9 | | 7/1981 |
| SE | 8601572-4 | | 4/1986 |
| SU | 1387966 | A1 | 10/1984 |
| SU | 1424788 | A1 | 2/1987 |
| TW | 85216339 | | 3/1997 |
| WO | WO98/06285 | | 2/1998 |
| WO | WO98/23174 | | 6/1998 |
| WO | WO99/08557 | | 2/1999 |

* cited by examiner

INSERT-MOLDED HELMET

This is a continuation application based on a previously filed non-provisional application, Ser. No. 09/160,655, filed Sep. 25, 1998 now U.S. Pat. No. 6,292,952 of which the benefit of priority is claimed.

FIELD OF THE INVENTION

This invention is directed to a comfortable, self-adjusting, cap-type protective helmet made from a process of insert-molding. More particularly the invention is directed to a helmet which is particularly useful for bicyclists and includes multiple segments arranged in particular advantageous ways and has a strategically-located chinstrap for improved stabilization. One embodiment of this invention includes an insert-molded helmet that can be converted into a pouch. Another embodiment of this invention comprises an improved strap guide. A further embodiment of this invention includes a protrusion at the back of a helmet suitable for a storage compartment.

BACKGROUND OF THE INVENTION

Protective helmets and other protective headgear have evolved over the years. It is not uncommon for individuals to wear protective headgear when they are, for example, riding bicycles, riding horses, roller-blading, playing football, playing baseball, playing hockey, skiing and skating, as well as for other general safety purposes. Conventional headgear is often stiff and thick, and made of impact-resistant materials that encase the skull of the wearer. While it is true that conventional headgear does to a certain degree protect the head of the wearer, it is typically stiff and thick and has many disadvantages.

Conventional headgear is, for instance, often very cumbersome. When removed from the head, such headgear is difficult to carry, particularly because of its size, shape and weight. Additionally, conventional headgear is uncomfortable to wear, often resulting in pain around the head and causing excessive perspiration around various parts of the head. One of the most serious flaws in typical headgear is its inability to fit the head of the user properly. Upon purchasing conventional protective headgear, the user often has to "force fit" the headgear to his or her head. The force fitting is achieved, most often, by inserting sizing pads into pockets around the internal brim of the headgear. While the use of sizing pads can result in somewhat better fitting protective headgear, the fit obtained with respect to the head of the user is not usually complete or tight and is subject to the uncertain skill of the person using the sizing pads. This means that portions of the protective headgear and protective headgear in combination with sizing pads do not come into direct contact with the head of the user, and therefore, an imperfect fit arises in, for example, the form of gaps between the head of the user and the headgear.

As a result of such an imperfect fit, it is believed that the head of the user can be subjected to "secondary impact" forces. This means that in the event of an accident or fall, the protective headgear will make contact with, for example, another bicycle rider or the ground or other obstacle, and the head of the user will come into contact (secondary impact) with the internal portions of the helmet. Such secondary impact is believed to diminish the protective capabilities of conventional helmets.

In addition to secondary impact, it is believed that conventional protective headgear which is force-fitted to the head of a user often fails to effectively dissipate loads created from contact. The failure to dissipate loads effectively can also contribute to serious head injuries.

It is of increasing interest to produce protective headgear that is comfortable to wear and able to effectively minimize the risk of head injuries. This invention, therefore, is directed in part to a superior protective helmet produced by a method of insert molding, and which embodies structural components that overcome substantial disadvantages of prior art helmets. These insert-molded protective helmets are comfortable, not cumbersome, and able to form fit to the head of the user to minimize the risk of injury during accidents or falls.

U.S. Pat. No. 5,515,546 assigned to the assignee of the instant application describes a foldable, padded helmet. Also, U.S. Pat. No. Re35,193, assigned to instant assignee, describes a pouch-forming protective helmet for bicyclists. These patents of the assignee are herein incorporated by reference.

While some of the prior art describes flexible helmets, such flexible helmets comprise a plurality of individual connecting parts assembled in a structure with substantial disadvantages, such as not conforming to the wearer's head. These prior art devices have a plurality of individual connecting parts which complicate the manufacturing process and do not generally provide necessary uniformity in hinging and sizing. In addition, the geometry of existing helmets does not generally allow for the construction of a helmet having a protrusion enabling the addition of a storage compartment at the back of the helmet. Furthermore, chinstraps of conventional helmets do not always provide maximum stability.

It is therefore an object of the present invention to provide a novel helmet made from a process of insert molding.

It is another object of this invention to provide a novel helmet comprising a plurality of segmented panels that conform to the wearer's head.

It is another object of this invention to provide a novel helmet comprising a plurality of segmented panels and having pivot axes substantially between horizontal and vertical, thereby allowing flexing of the panels around the wearer's head.

It is another object of this invention to provide a novel helmet comprising six segmented panels arranged in a particularly advantageous way.

It is another object of this invention to provide a novel helmet comprising a plurality of segmented panels that conform to the wearer's head, with the absence of a fitting panel in front.

It is another object of this invention to provide a novel helmet comprising a plurality of segmented panels that conform laterally about the wearer's head.

It is another object of this invention to provide a novel helmet having at least two segmented panels on each side of the wearer's head.

It is another object of this invention to provide a novel helmet comprising five segmented panels that conform laterally about the wearer's head and further includes a top panel.

It is another object of this invention to provide a novel helmet wherein a top panel straddles two side segmented panels disposed on each side of the wearer's head.

It is another object of this invention to provide a novel helmet wherein a top panel overlaps gaps between the top panel and peripheral panels, thereby further protecting the wearer's head from leakage of substances onto the wearer's head.

It is another object of this invention to provide a novel helmet wherein gaps between segmented panels are staggered to prevent unwanted folding or other instability or lack of integrity of fit of the helmet.

It is another object of this invention to provide a novel helmet having uniformity in hinging and sizing through a one-piece armature.

It is another object of this invention to provide a novel helmet comprising an armature molded within segmented panels of the helmet with reinforcement limiter tabs attached to the armature between the panels.

It is another object of this invention to provide a novel helmet wherein a top panel is connected to peripheral panels with loops formed by an armature molded in the peripheral panels.

It is another object of this invention to provide a novel helmet comprising an armature molded within segmented panels of the helmet and discontinuous at the top of the helmet.

It is another object of this invention to provide a novel helmet comprising an armature molded within segmented panels of the helmet whereby the armature is non-integrally connected to the top panel or panels of the helmet.

It is another object of this invention to provide a novel helmet comprising an armature insert-molded within segmented peripheral panels of the helmet and tabs protruding from the armature also insert-molded into the top panel or panels of the helmet.

It is another object of this invention to provide a novel helmet wherein an armature is insert-molded within peripheral panels.

It is another object of this invention to provide a novel helmet wherein an armature is insert-molded within peripheral panels and a separate armature is insert-molded within a top panel or panels, and the two armatures are connected as a means of securing the top panel or panels to the peripheral panels.

It is another object of this invention to provide a novel helmet with a strategically-located retention system for improved stabilization.

It is another object of this invention to provide a novel helmet comprising a plurality of segmented panels and a retention system that brings the panels close to the wearer's head thereby conforming to the size and shape of the wearer's head.

It is another object of this invention to provide a novel helmet with a retention system coupled to at least one of the following: the front of the top segment of the helmet, the central area of the top segment of the helmet, the back of the top segment of the helmet, the peripheral panels of the helmet, the outside of the helmet, and to an armature, wherein the armature is insert-molded within the helmet.

It is another object of this invention to provide a novel helmet comprising an armature molded within segmented panels of the helmet with protrusions on the armature for coupling the retention system to the armature.

It is another object of this invention to provide a novel helmet having two segments disposed from the wearer's forehead to the wearer's neck.

It is another object of this invention to provide an improved helmet that can also function as a pouch for holding small objects and can be attached about the waist or hung over the shoulder when not worn on the wearer's head. is yet a further object of this invention to provide a helmet with a protrusion extending from the back of the helmet in which a storage compartment can be formed.

Other objects and advantages of the invention will become apparent by review of the detailed description of preferred embodiments.

SUMMARY OF THE INVENTION

The invention is directed to a comfortable, self-adjusting, protective helmet preferably made from a process of insert molding. The helmet comprises an armature, or insert portion, made of a flexible, porous material that is embedded as a layer of the helmet to connect the structural parts of the helmet to one another. The helmet can also comprise a number of peripheral panels connected by the armature in the manner of a string of beads. The top of the helmet can be fitted to the peripheral panels with loops formed by the armature for securing the top piece or pieces to the peripheral panels. Alternatively, the top piece or pieces can be insert molded with a separate armature and the two armatures can be connected as a means of securing the top piece or pieces to the peripheral panels. The armature as used in the helmet also serves several other functions which include hinging and sizing functions where it is exposed between panel gaps. A decorative shell can cover the panels on the sides and the top of the helmet. A retention system is strategically located on the helmet to provide increased stabilization of the helmet on the wearer's head. In addition to improved helmet stability resulting from the strap geometry, controlled placement of the straps results in improved side of skull adjustability and reduced potential for misuse or poor adjustment. The retention system pulls the panels close to the wearer's head, thereby causing the panels to further conform to the size and shape of the wearer's head.

In one embodiment of the invention, the helmet can be folded to convert the helmet into an article-carrying pouch. Once the helmet is converted into a pouch, the pouch can be worn around the wearer's waist or hung over the wearer's shoulder using an adjustable strap attached to the helmet. By converting the helmet into a pouch, the wearer need not carry around a helmet, and furthermore can carry such items as gloves or sunglasses in the pouch.

In another embodiment of the invention, the helmet comprises an improved strap guide wherein a locking mechanism is provided by recesses molded in the liner of the helmet.

In a further embodiment of the invention, a protrusion is formed at the back of the helmet. A cavity can be formed within this protrusion in the back of the helmet for the purpose of carrying small items. Such items can include a satellite navigation system, telephone system, homing device, keys, money or numerous other items.

The above described objects and embodiments are set forth in the following description and illustrated in the drawings described hereinbelow.

DETAILED DESCRIPTION OF THE PREFERRED EMBODIMENTS

Figure 1:
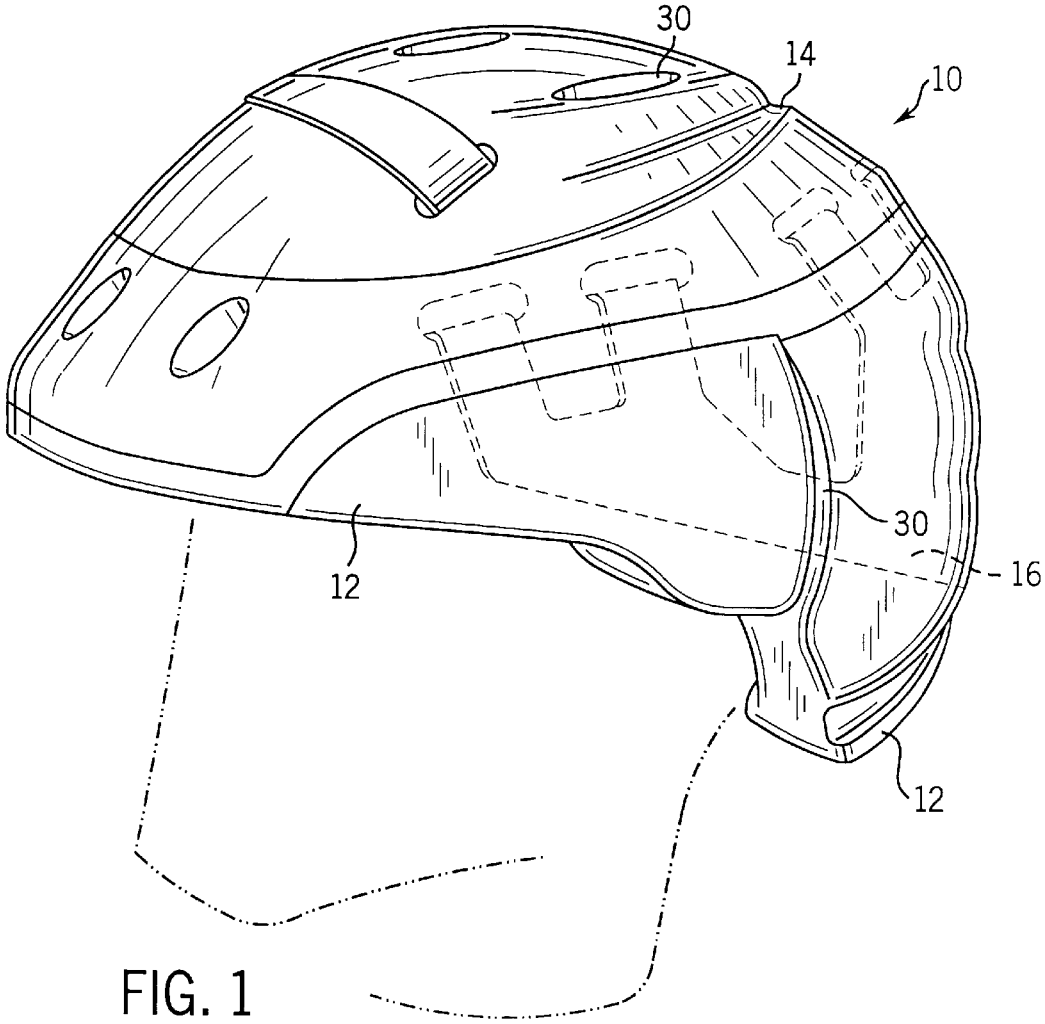
FIG. 1 is a perspective view of a helmet.

FIG. 1 is a perspective view of one preferred embodiment of the invention. In FIG. 1 a one-piece armature 16 (shown as a darkened region within dashed lines) is embedded within and connects a plurality of peripheral panels 12 and a top panel 14 to form a helmet 10. The one-piece armature 16 is preferably made of a non-stretch, flexible, porous material that is insert-molded into the panels 12 and 14. A wide variety of materials can be used for the armature 16, but in a preferred embodiment, the armature material is a commercial product comprising spun polyester fibers woven into mesh and coated with polyvinylchloride (PVC). The material is die-cut to the shape of the armature 16.

Figure 2:
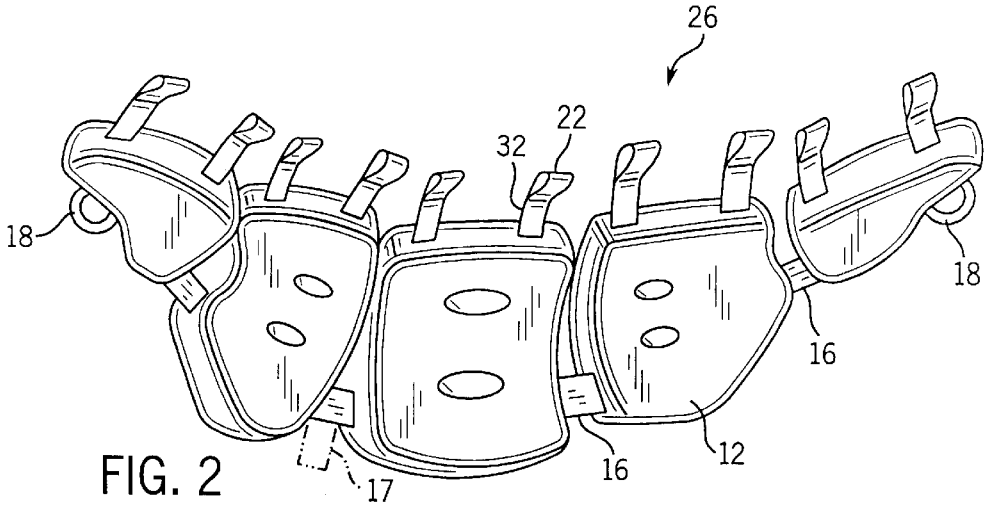
FIG. 2 is a view of a peripheral panel assembly making up a portion of a helmet.

In a preferred method, insert molding is carried out by placing the armature 16 into a mold wherein expandable polystyrene (EPS) is injected to create a final part in the shape of each of the plurality of the peripheral panels 12, resulting in the armature 16 being embedded within a peripheral panel assembly 26 (see FIG. 2). The one-piece armature 16 eliminates the need for a plethora of smaller connectors to link all of the panels 12 and 14, thereby simplifying the manufacturing process. In addition, use of the one-piece armature 16 provides added uniformity in hinging the panels 12 and 14 to one another and uniformity in over-all sizing and fit of the helmet 10.

The plurality of the panels 12 and 14 allows the helmet 10 to self-adjust and conform to the shape of the wearer's head due to the flexibility of the armature 16. The plurality of panels 12 and 14 also limits the spread between the panels 12 and 14. In a preferred embodiment, the peripheral panels 12 comprise at least two panels 12 on each side of the wearer's head and a peripheral panel 12 at the back of the wearer's head, for a total of at least five peripheral panels 12 attached to the top panel 14. In this preferred embodiment, panels, the top panel 14 and a peripheral panel 12 at the back of the wearer's neck, are disposed from the wearer's forehead to the wearer's neck. The plurality of peripheral panels 12 provides conformity to the shape of the wearer's head such that merely one top panel 14 is sufficient, although more than one top panel 14 may be used. Since the armature 16 connects the peripheral panels 12 to one another, as well as to the top panel 14, self-adjustment occurs in both horizontal and vertical directions. This conformity to the wearer's head provides extraordinary comfort as well as safety. In a crash or other contact with the helmet 10, the initial impact wherein the helmet 10 comes in contact with a surface can be less damaging to a helmet wearer compared to secondary impact wherein the wearer's head hits the inside of the helmet 10. By conforming to the wearer's head so closely, this helmet 10 provides exceptional safety in terms of lessening secondary impact. Furthermore, the conformity of the helmet 10 to the wearer's head eliminates the need for sizing pads typically required to make helmets fit the wearer's head. Sizing pads in the prior art are typically inserted into pockets around the internal brim of helmets to ease discomfort and reduce some misfit in helmets. The maximum size of the helmet 10 is dependent on the size of the armature 16, which should be large enough to allow the helmet 10 to fit virtually all adult wearers' heads in general, while the flexibility of the armature 16 allows the helmet 10 to conform to practically all head shapes. A somewhat smaller version is available for children and exhibits all the advantages of an adult form of the helmet 10.

In a preferred embodiment of the helmet 10 the top panel 14 overlaps gaps 15 (see FIG. 3) between the top panel 14 and the peripheral panels 12, thereby protecting the wearer's head from leakage of substances onto the wearer's head. Also in a preferred embodiment, the gaps 15 between the panels 12 and 14 are staggered to prevent unwanted folding or other instability and enhance the integrity of fit of the helmet 10.

Furthermore, in a preferred embodiment of the helmet 10 in FIG. 1 there are vents 30 between some of the panels 12 and 14 in order to prevent the wearer from overheating during warm weather or during strenuous physical exertion. Additional ones of the vents 30 can be molded within the panels 12 and 14 to provide additional means to combat overheating. Ideally, the armature 16 is large enough and flexible enough to allow adequate room beneath the helmet 10 for a person to wear a cap beneath the helmet 10 for enhanced protection from the cold as well. Again, the versatility and goodness of fit enable a wearer to use the helmet 10 with a cap or other head covering without need to add different sizing pads or the like for different seasons or conditions of wear.

FIG. 2 shows the peripheral panel assembly 26 during assembly prior to attachment to the top panel 14. Since the armature 16 is discontinuous at the top, tabs 32 from the armature 16 extend upward from the peripheral panels 12, forming attachment loops 22. These tabs 32 are preferably folded lengthwise first and then sewn to form the attachment loops 22 for added strength prior to attaching the top panel 14 to the peripheral panels 12. In an alternate embodiment, the tabs 32 from the armature 16 are insert-molded to the top panel 14. Reinforcement limiter tabs 17 (shown in phantom) can also be sewn to the armature 16 where the peripheral panels 12 are joined. The tabs 17 provide additional strength. Chinstrap hangers 18 can be attached to, or protrude from, the armature 16 for added conformity of the helmet 10 to the wearer's head.

Figure 3:
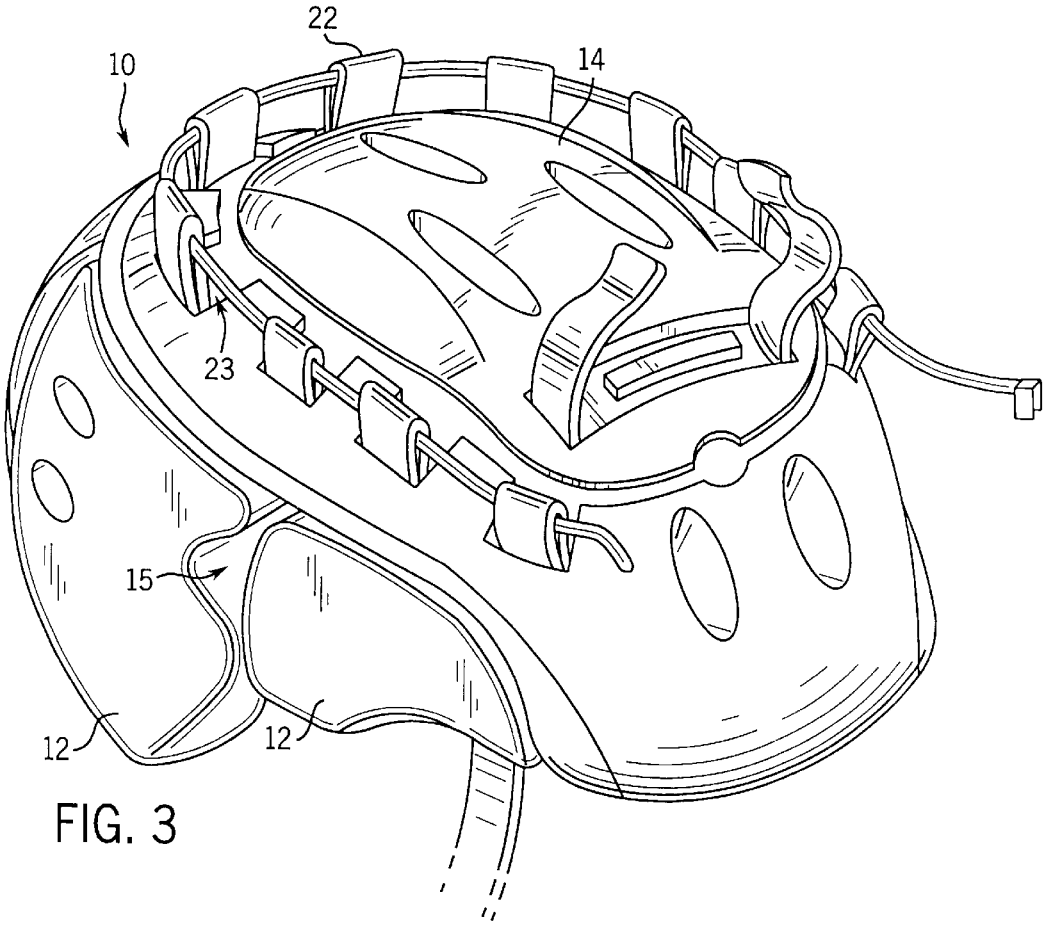
FIG. 3 is a perspective view of the top and right side of a helmet, showing attachment of the top panel to a peripheral panel assembly.

FIG. 3 is a perspective view of the top and right side of the helmet 10 during assembly, showing attachment of the top panel 14 to the peripheral panels 12. The attachment loops 22 of the armature 16 are inserted through holes 23 in the top panel 14, thereby securing the peripheral panel assembly 26 to the top panel 14. The panels 12 and 14 can be molded of EPS or any other suitable padding material. In addition, a decorative shell (not shown) can cover the panels 12 and 14 on the sides and the top of the helmet 10.

In an alternate embodiment, the armature 16 can be insert-molded within the peripheral panels 12, and the separate armature 16 can be insert-molded within the top panel 14 or panels. The two armatures 16 can then be connected as a means of securing the top panel 14 or panels to the peripheral panels 12.

Figure 4A:
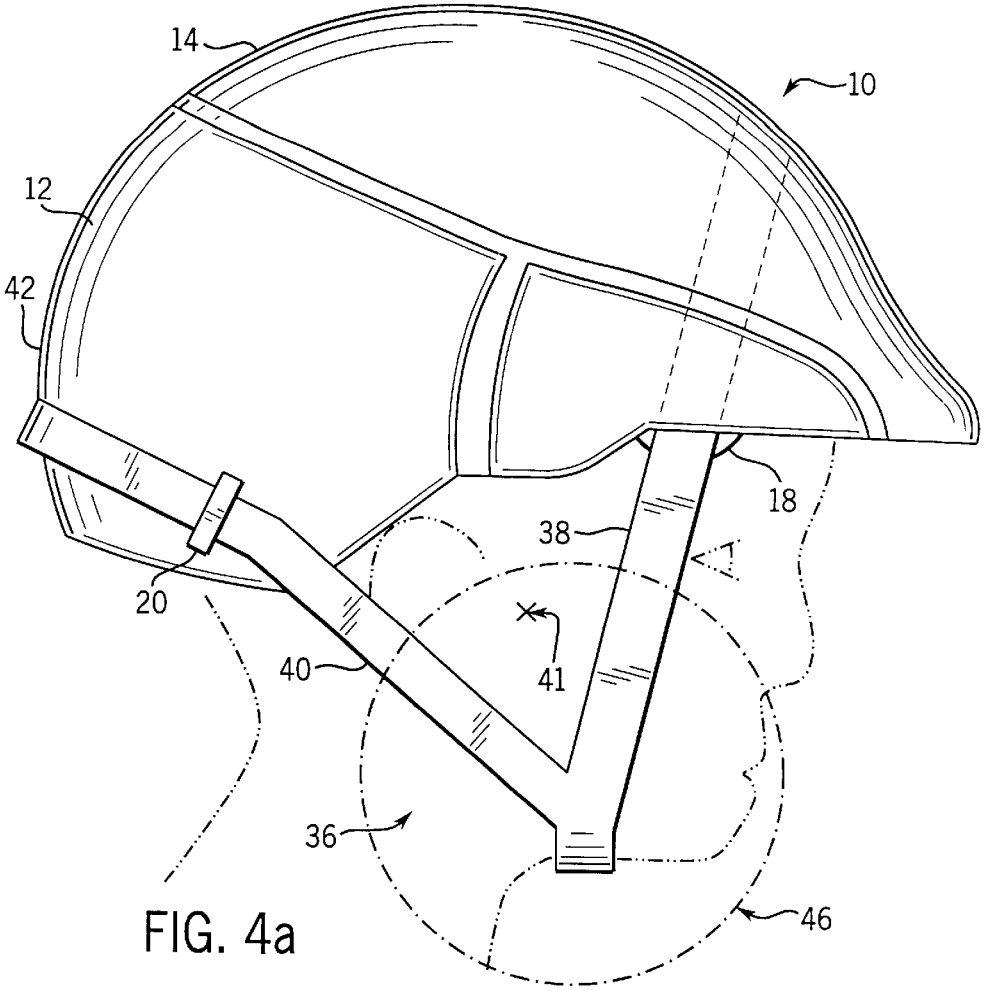
FIG. 4*a* is a longitudinal section view, taken along line 1—1 of FIG. 1, of a helmet in a child's size.

FIG. 4*a* is a longitudinal section view, taken along line 1—1 of FIG. 1, of the preferred form of the helmet 10 in a child's size, demonstrating the location of a retention system 36. The retention system 36 features a chinstrap 38 and a nape strap 40 made of, for example, nylon. The left and right sides of the chinstrap 38 are routed through the top panel 14 (see dashed lines) for strength. The chinstrap 38 can be coupled to the front, central area or back of the top segment 14 of the helmet 10. The nape strap 40 is preferably attached to an exterior surface 42 of the rear peripheral panels 12 to provide stability and fit. The chinstrap hangers 18 and nape strap guides 20 are attached to the exterior surface 42 of the helmet 10. In a preferred method of manufacture, the chinstrap hangers 18 and the nape strap guides 20 comprise pellets which have been injected into molds for achieving their final shape. The chinstrap hangers 18 and the nape strap guides 20 can also be manufactured by injection molding, die cutting or thermoforming processes. By securing the straps 38 and 40 in the manner shown and described, both horizontal and vertical stabilization is achieved when the helmet 10 is secured to the wearer's head.

Figure 4B:
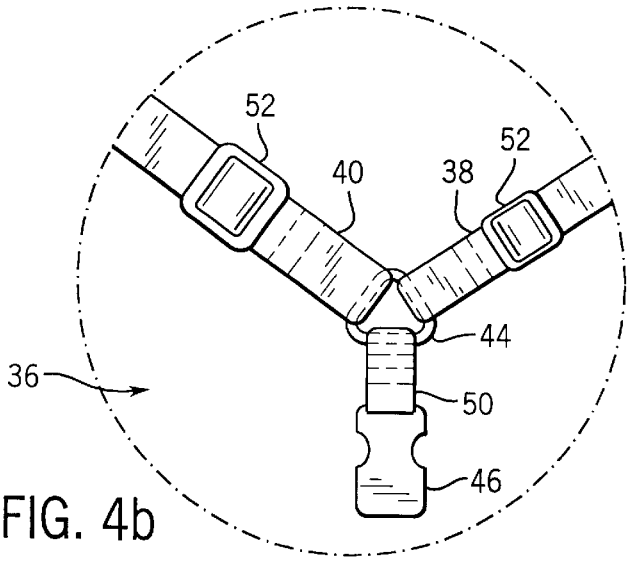
FIG. 4*b* is a partial section view of a retention system of the helmet of FIG. 4*a;*

FIG. 4*b* is a partial section view of the retention system 36 of the helmet 10 of FIG. 4*a*. The straps 38 and 40 are joined at a triangular ring 44 to draw them inward against the wearer's head when they are tensioned. The triangular ring 44 is then attached to a buckle 46 with a short loop of strapping 50. Both the chinstrap 38 and the nape strap 40 are allowed to slide around the triangular ring 44 to adjust their lengths. The ends of the straps 38 and 40 are then terminated at slide adjusters 52, such as Tri-glides™ a trademark of Nexus Corporation, located on each of the respective straps 38 and 40.

If not secured, helmets in general have a natural tendency to rotate on a wearer's head about a virtual pivot point 41. To prevent forward rotation of the helmet 10 of this invention, the nape strap 40 is fixed from the rear of the helmet 10 to the wearer's jaw at a distance far away from the pivot point 41 (see FIG. 4*a*). An ideal system provides excellent stability and can accommodate some amount of slack in the straps 38 and 40 since large amounts of slack are required for the helmet 10 to rotate a significant amount. Fixing the chinstrap 38 at a relatively short length provides good forward and rearward roll resistance. The short, fixed-length chinstrap 38 also maintains the pivot point 41 in an area central to the chinstrap 38 and the nape strap 40 rather than directly on or in close proximity to either of the straps 38 and 40. In a typical helmet retention system, there are approximately six adjustment points or degrees of freedom, each controlled by the user which can lead to poor locations of the straps resulting in poor stability. A preferred embodiment of the retention system 36 of the present invention having a short, fixed-length chinstrap 38 has only two points of adjustment, namely the nape strap 40 and the short loop of strapping 50. Hence the potential for a wearer to place the straps 38 and 40 in a poor location is highly limited. The only foreseeable misuse of the system 36 would be caused by a wearer leaving large amounts of slack in the nape strap 40 or strapping 50, or not even fastening the buckle 46. In both of these cases, the helmet 10 will not be fitted properly to the wearer, making the wearer aware that something needs to be corrected. This configuration creates pivot axes substantially between horizontal and vertical, thereby enhancing flexibility, and thus fit, of the panels 12 and 14 around the wearer's head. The retention system 36 is self-adjusting in that securing the retention system 36 to the head simultaneously pulls the peripheral panels 12 against the wearer's head and adjusts the fit of the helmet 10.

The placement and location of the chinstrap 38 on a child's head is a factor often overlooked by many major helmet manufacturers. The mandible or jaw of the child develops rapidly over the initial years from a small recessed bone to the large prominent bone found in adults. This requires the chinstrap 38 to be located much further back and at an inclined orientation to the skull to achieve good stability for protective purposes as well as for comfort. The location of the retention system 36 on the helmet 10 lends itself very well to providing good fit and stability over a large age range.

A safe, comfortable form of the helmet 10 is provided by the invention for children that will also expand along with the child's head. The child's model of the helmet 10 is a cost-effective alternative for parents who would otherwise have to replace their child's helmet 10 progressively as the child's head grows. In terms of helmet design, in an alternate embodiment, a toddler's helmet can include softer and thicker walls of the peripheral panel assembly 26 in view of the lower impact tolerance and lighter weight of a toddler's head. This is accomplished by providing the softer, thicker walls of the peripheral panel assembly 26 in an interior shape similar to human heads, and meeting the stability requirements of the CPSC bicycle helmet standard.

Figure 5A:
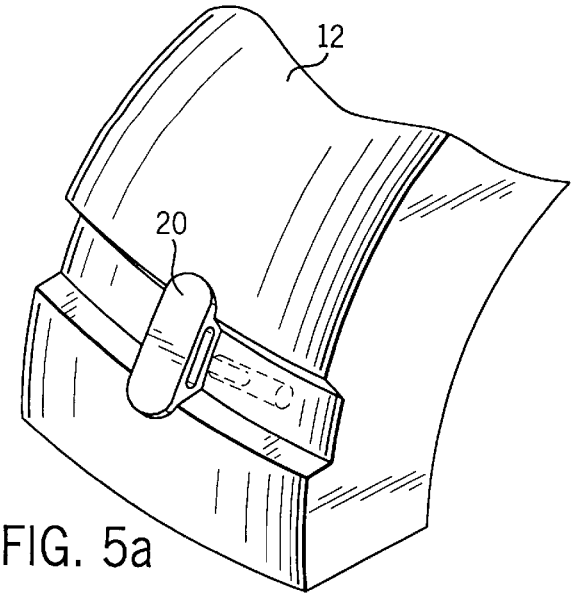
FIGS. 5*a*, 5*b*, 5*c* and 5*d* are partial section views of a peripheral panel of the helmet of FIG. 1 showing an interior receptacle and an exterior receptacle for a strap guide.
Figure 5B:
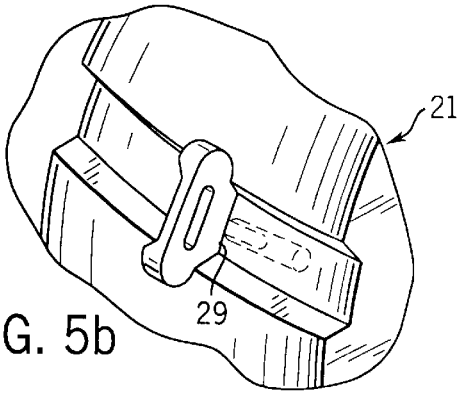
Figure 5C:
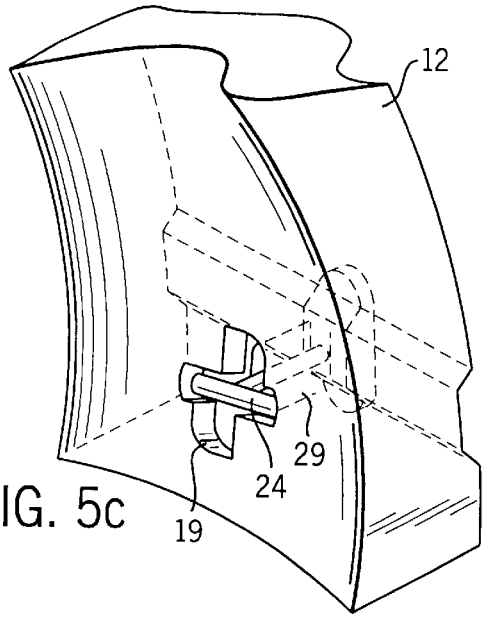
Figure 5D:
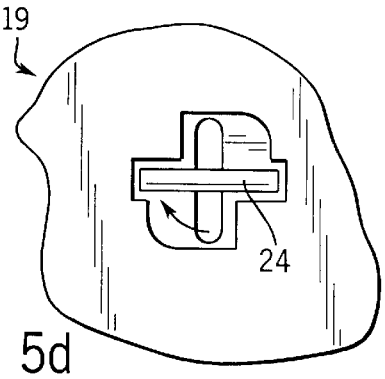

FIGS. 5*a* and 5*b* are partial section views of a preferred form of one of the peripheral panels 12 showing an exterior receptacle 21 for the strap guide 20. FIGS. 5*c* and 5*d* are partial section views of a preferred form of one of the peripheral panels 12 showing an interior receptacle 19 for the strap guide 20. The strap guide 20 consists of a single part tab 24 constructed of a soft plastic (low density polyethylene or thermoplastic elastomer) and is inserted into a slot 29 (see FIG. 5*c*) molded into the peripheral panels 12. The tab 24 is locked into place with one end of the tab 24 inserted into the slot 29 in the peripheral panels 12 until the tab 24 is exposed inside the helmet 10 and then twisted ninety degrees to its locked position (see FIG. 5*d*). A sharp edge under the tab 24 and a recess forming the exterior receptacle 21 provide for semi-permanent attachment of the guide 20 to the helmet 10. The tab 24 can be locked from the side with a protrusion in the exterior receptacle 21 which must be overridden by the tab 24 when twisted into the locked position. The locked position of the tab 24 corresponds to its initial shape before insertion, thereby requiring manual intervention to unlock the mechanism since it will not unwind during normal use. Access to the tab 24 can be limited by keeping the interior receptacle 19 small enough to prevent fingers from reaching the tab 24 or by covering the interior receptacle 19 with a comfort pad. The flexibility of the tab 24 allows the tab 24 to buckle and collapse under impact, however, the tab 24 is sufficiently strong to prevent it from being pulled out by the wearer.

Figure 6:
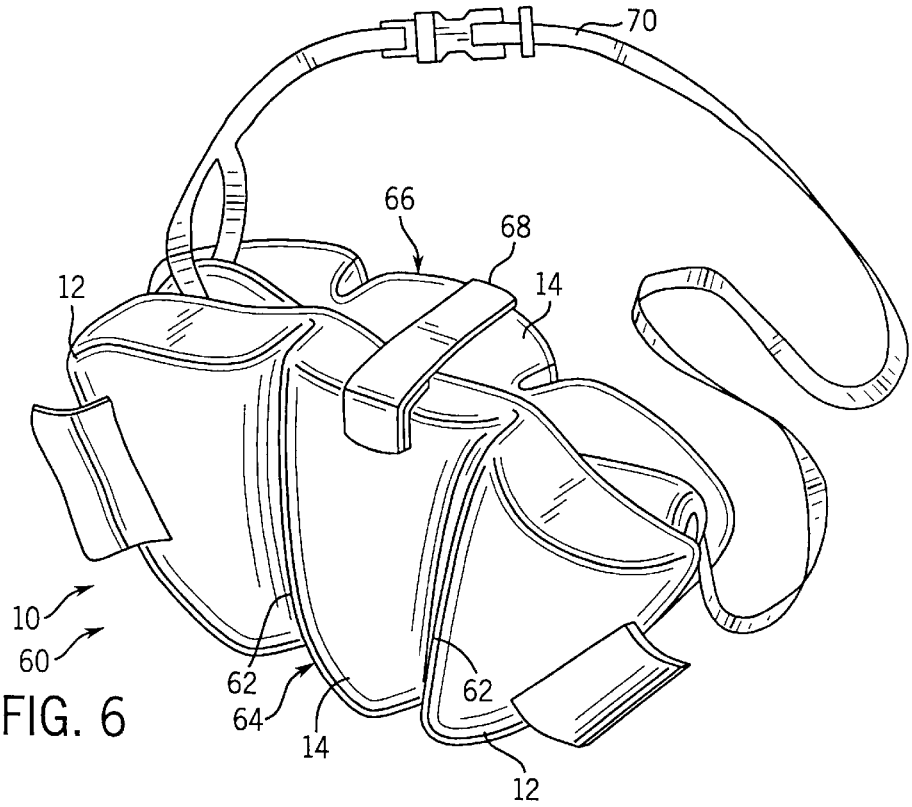
FIG. 6 is a perspective view of an alternate embodiment of a helmet in a pouch mode.

FIG. 6 shows an alternate embodiment and use of the invention wherein the helmet 10 can be folded in such a way as to convert the helmet 10 into an article-carrying pouch 60. In this embodiment, the helmet 10 can comprise two top panels 14 and a plurality of circumferentially-spaced, generally radial, fold lines 62 emanating from the center of the top of the helmet 10. The fold lines 62 include aligned fold lines running over both sides of the top panels 14 facilitating folding of the helmet 10 about the aligned transverse fold lines. Foldable front and rear halves 64 and 66 of the top of the helmet 10 define, between them, an article-carrying pouch cavity. A fastener 68 is provided for latching the front and rear halves 64 and 66 together to hold articles placed therein. The fastener 68 can comprise a variety of different types of fasteners, including Velcro™, snaps, or a zipper. A belt and shoulder strap system 70 of adjustable length can be included on the helmet 10, allowing the combined helmet and the pouch 60 to be suspended from the shoulder of the wearer or worn as a belt strapped about the waist of the wearer. By converting the helmet 10 into the pouch 60, the wearer need not carry around a cumbersome helmet, and furthermore can carry such items as gloves or sunglasses in the pouch 60. For folding purposes, the preferred number of total panels 12 and 14 is six, but a higher number is still quite feasible.

Figure 7:
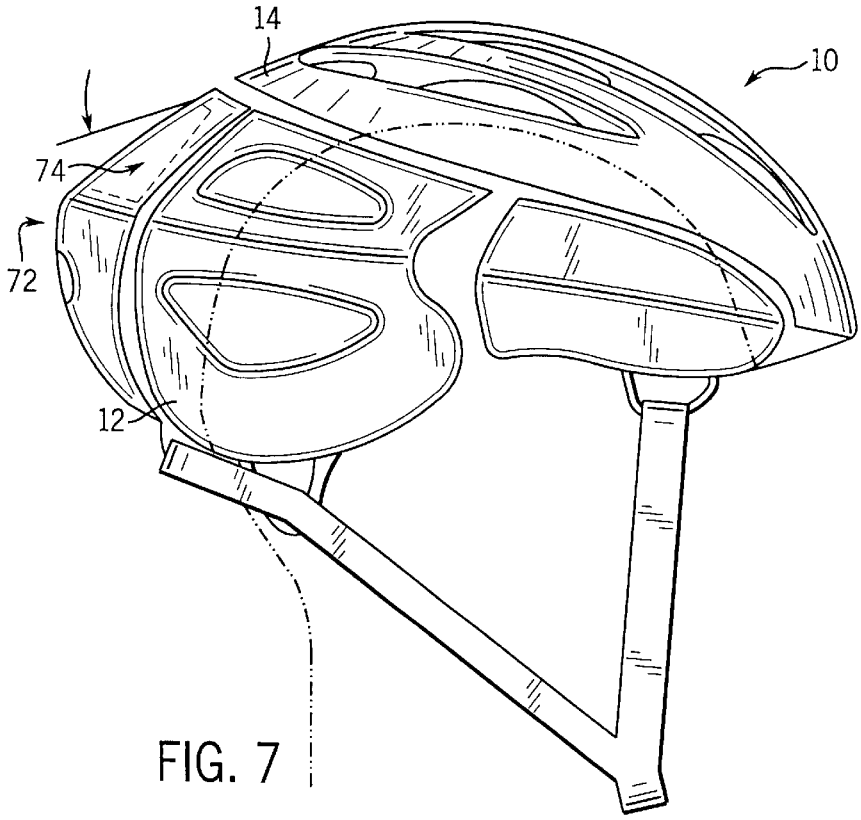
FIG. 7 is a right side view of a helmet having a protrusion at the back of the helmet.

FIG. 7 is a right side view of another embodiment of the invention comprising a protrusion 72 at the back of the helmet 10 wherein the protrusion 72 can accommodate a storage compartment 74. Because of this geometry, particularly the concept of the peripheral panels 12 attached to the top panel 14, the helmet 10 would not be thrown off balance with the addition of the protrusion 72 the way typical helmets would be. The compartment 74 in the protrusion 72 could be used for many purposes, including holding a satellite navigation system, telephone system, homing device, keys, money or numerous other items.

Figure 8:
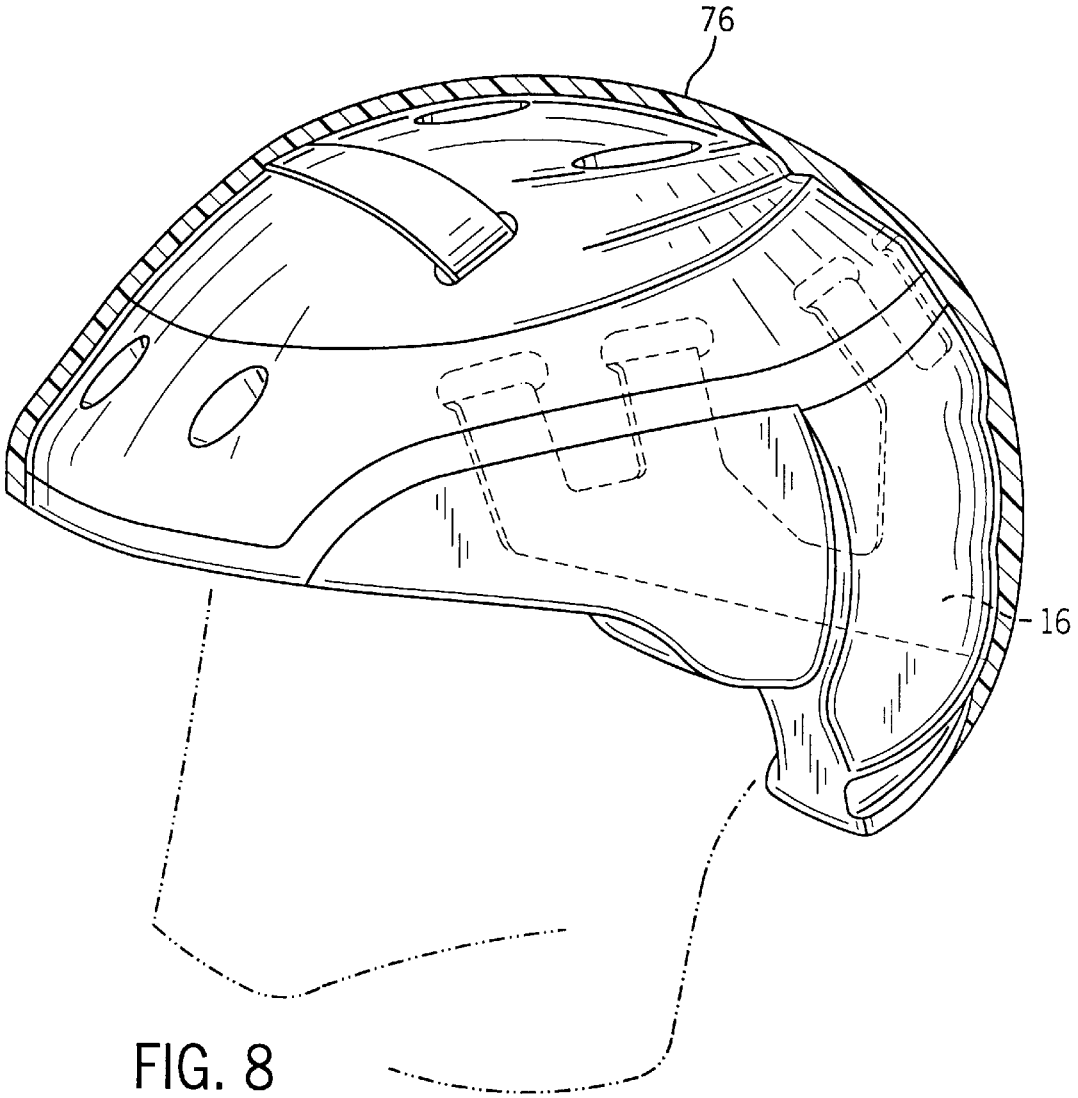
FIG. 8 is a longitudinal section view of a helmet showing one allen-compassing exterior shell with an armature insert-molded within the helmet.

FIG. 8 is a view of another alternate embodiment of the invention showing one all-encompassing exterior shell 76 (in cross-section) with the armature 16 insert-molded within the helmet 10 to provide a contoured fit to the wearer's head.

While preferred embodiments have been shown and described, it should be understood that changes and modifications can be made therein without departing from the invention in its broader aspects. Various features of the invention are defined in the following claims.

What is claimed is:

1. A helmet, comprising:

a plurality of side panels adapted to be disposed laterally about a wearer's head, each of the side panels adapted to be disposed on one side of the wearer's head;

a top panel adapted to be disposed generally above the wearer's head and coupled to at least one of the plurality of side panels; and a retention system coupled to at least two of the plurality of side panels and having a secured position and an unsecured position, wherein the plurality of side panels have structural adjustability in at least two directions.

2. The helmet of claim 1, wherein the top panel is coupled to each of the side panels.

3. A helmet, comprising:

a plurality of side panels adapted to be disposed laterally about a wearer's head;

a top panel adapted to be disposed generally above the wearer's head and coupled to at least one of the plurality of side panels; and a retention system coupled to at least two of the plurality of side panels and having a secured position and an unsecured position, wherein the plurality of side panels have structural adjustability in at least two directions, wherein the plurality of side panels are sequentially and serially coupled to each other.

4. The helmet of claim 3, further comprising a singular armature for coupling each of the side panels to each other.

5. The helmet of claim 4, wherein the armature is non-integrally connected to the top panel.

6. The helmet of claim 4, wherein the armature is embedded in at least one of the plurality of side panels.

7. The helmet of claim 6, wherein the armature is insert-molded in each of the plurality of side panels.

8. A helmet, comprising:

a plurality of side panels adapted to be disposed laterally about a wearer's head;

a top panel adapted to be disposed generally above the wearer's head and coupled to at least one of the plurality of side panels; and a retention system coupled to at least two of the plurality of side panels and having a secured position and an unsecured position, wherein the plurality of side panels have structural adjustability in at least two directions, wherein the retention system comprises:

a chin strap at least partially disposed within the top panel; and a nape strap operatively connected to the chin strap.

9. The helmet of claim 8, wherein the nape strap is coupled to an exterior surface of at least one of the plurality of side panels.

10. The helmet of claim 9, further comprising a coupling strap operatively connected to the nape strap and the chin strap for securing the helmet upon the wearer's head.

11. The helmet of claim 10, wherein the nape strap and the coupling strap are adjustable in length.

12. The helmet of claim 8, further comprising a decorative shell covering at least the top panel.

13. A helmet, comprising:

a top panel;

a rear panel;

a right panel;

a left panel; and means for operatively connecting the top panel, the rear panel, the right panel, and the left panel to each other such that the rear panel, the right panel, and the left panel are capable of both lateral and rotational movement.

14. The helmet of claim 13, further comprising a retention system having a secured position and an unsecured position, the retention system securing the helmet to a wearer's head when in the secured position.

15. The helmet of claim 14, wherein the retention system is adjustable in length to more adequately conform to the shape of a wearer's head.

16. The helmet of claim 13, wherein each of the left panel, the right panel, and the rear panel are sequentially and serially coupled to each other.

17. The helmet of claim 16, further comprising a decorative shell covering at least the top panel.

18. A helmet, comprising:

a plurality of side panels adapted to be disposed laterally about a wearer's head, each of the plurality of side panels flexibly and serially coupled to each of the other of the plurality of side panels; and a top panel connected to at least one of the plurality of side panels, wherein the plurality of side panels are rotatable about at least two axes.

19. The helmet of claim 18, further comprising an adjustable tightening system connected to the top panel and at least a portion of the plurality of side panels.

20. A helmet, comprising:

a plurality of side panels adapted to be disposed laterally about a wearer's head, each of the plurality of side panels flexibly and operatively coupled to each of the other of the plurality of side panels;

a top panel connected to at least one of the plurality of side panels;

an adjustable tightening system connected to the top panel and at least a portion of the plurality of side panels; and a singular armature for flexibly coupling the plurality of side panels to each other.

* * * * *